United States Patent [19]

Carlow

[11] 4,369,487

[45] Jan. 18, 1983

[54] UTILITY LAMP

[75] Inventor: Arthur J. Carlow, Beverly, Mass.

[73] Assignee: Carico Corporation, Beverly, Mass.

[21] Appl. No.: 186,840

[22] Filed: Sep. 15, 1980

[51] Int. Cl.[3] ..... F21V 27/00

[52] U.S. Cl. ..... 362/258; 362/369; 362/376; 362/378; 362/387; 362/390; 362/396; 362/398; 362/399; 362/400

[58] Field of Search ..... 362/258, 369, 376, 378, 362/387, 390, 396, 398, 399, 400

[56] References Cited

U.S. PATENT DOCUMENTS

| | | | |
|---|---|---|---|
| 3,294,968 | 12/1966 | Cloyd | 362/387 |
| 3,308,289 | 3/1967 | Conradi | 362/258 |
| 3,809,883 | 5/1974 | Goodwin | 362/258 |
| 4,258,414 | 3/1981 | Sokol | 362/398 |

*Primary Examiner*—Stephen J. Lechert, Jr.
*Attorney, Agent, or Firm*—Cesari and McKenna

[57] ABSTRACT

A utility lamp has a tubular handle for containing a bulb receptacle connected to a cord extending out of the handle and terminated by a connector. A bulb cage or guard is removably clamped to the handle to protectively enclose a bulb inserted in the receptacle. Formed integrally with the bulb guard is a cord storage section about which the length of cord extending from the handle can be wound. A stand is formed at the free end of the bulb guard permitting the utility lamp to be stood on end on a horizontal surface. Also, a hook is swively mounted to the top of the bulb guard so that the lamp can be hung from an elevated projection and a magnet is mounted to the cord storage section enabling lamp to be suspended from a ferromagnetic object.

30 Claims, 5 Drawing Figures

UTILITY LAMP

This invention relates to a lamp. It relates more particularly to an improved utility lamp for illuminating a work site.

BACKGROUND OF THE INVENTION

Utility lamps of the general variety with which we are concerned here have been available for many years. Such lamps usually include a handle containing a lamp socket and switch and some kind of cage for protectively enclosing the lamp bulb screwed into the socket. A long electrical cord has one end extending through the handle and connected to the socket while its other end is terminated by a standard male electrical plug. To use the utility lamp, the worker inserts the electrical plug into an electrical outlet and positions the lamp in a suitable location at the work site. A hook, clip or other such fastener is often mounted to the lamp to enable the lamp to be suspended from or anchored to a suitable support at the site.

While prior lamps of this variety perform their illuminating function quite satisfactorily, they do have certain drawbacks. For example, some prior utility lamps have protective bulb cages which simply engage over the bulb and are separate from the handle. Accordingly, the cage does not adequately protect the bulb. Also when a bulb burns out and has to be replaced, the cage must be separated from the handle. Resultantly, sometimes the cage becomes lost so that the worker is forced to use the utility lamp with a completely unprotected and unshielded bulb which is a dangerous practice.

Some conventional lamps, while having an integral handle and cage construction, fabricate the cage out of metal making the overall appliance relatively expensive. Also, the cage is electrically conductive so that, when the worker is engaged in electrical repairs, the lamp cage can provide a conductive path from a "hot" conductor to ground or to the worker and therefore can cause short circuits and shocks.

Prior lamps of this type are also inconvenient to use. This is because the lamp cord often becomes twisted, tangled and knotted requiring the worker to take the time to straighten out the cord before he can use the lamp. The main reason for this is that usually no provision is made for storing the lamp cord. The cord is simply coiled up by hand or wound around the lamp handle, neither of which is a very effective procedure for maintaining a cord in a tangle-free condition. There are some prior lamps that have tried to overcome this problem by storing the cord on an integral spring-loaded reel. However, such appliances are quite expensive. Furthermore, they are quite bulky and unwieldly so that it is difficult to work in close quarters with them.

SUMMARY OF THE INVENTION

Accordingly, it is an object of the present invention to provide an improved utility lamp which is relatively inexpensive to make.

A further object is to provide a utility lamp which is easy and safe to use.

Yet another object of the invention is to provide a utility lamp which includes storage for the lamp cord.

Yet another object of the invention is to provide a utility lamp which is designed so that is can be positioned at just the right location at a work site to effectively illuminate the parts or pieces being worked on.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the utility lamp of this invention includes a bulb holder, a protective bulb shield and a lamp cord storage section which are all molded or otherwise formed of a rugged impact-resistant plastic, the latter two parts of the lamp being formed as a single unitary piece. The plastic handle is hollow to receive a standard switched lamp socket and a lamp cord connected to the socket and which extends out of the end of the handle terminating in a conventional electrical plug.

Provision is made for removably clamping the cage and cord storage sections to the handle so that the cage completely envelops and protects the bulb inserted into the lamp socket. The cage is composed of two shell-like halves connected by an integral hinge, thereby permitting the cage to be opened in order to replace the bulb in the lamp socket without having to disconnect the cage from the handle. Therefore, replacement of the bulb does not involve moving or loosening fasteners or other parts which could become lost.

The cord storage section of the lamp attached to the cage is in the form of an elongated bobbin or spool extending parallel to the lamp handle and around which the cord can be wrapped. When the lamp is not in use, the cord is wound around the spool, the lamp and wrapped cord form a compact package which can be stored in a minimum amount of space.

When using the lamp, the worker inserts the lamp plug into the nearest electrical outlet and unwraps from cord storage only sufficient cord to enable the lamp handle to be positioned at the work site. Therefore, there is little likelihood of the lamp cord becoming knotted, twisted or tangled.

The present lamp also includes provision for anchoring or supporting the lamp at the work site in a variety of different ways. In this, the cage and cord storage section cooperate to provide feet which enable the lamp to stand on end on a flat surface so as to shed of focus its light along that surface. Also, the storage section of the lamp is provided with a flat surface which permits the lamp to rest stably on its side on such a surface. Further, a special magnetic pad is incorporated into that same section to enable the lamp to be supported or suspended from a ferromagnetic surface such as a steel door or plate. Finally, a multiple-position hook is mounted to the lamp to permit the lamp to be suspended from a peg, pipe or other projection in the event that work has to be performed at an elevated location.

Thus the present lamp can be positioned in a variety of different ways at the work site depending upon the particular circumstances. Accordingly, even though the work has to be performed in very close quarters, the lamp can usually always be supported in one or another of its operative positions so as to adequately illuminate the area. By the same token, when the lamp is not in use and the cord is wound up on the storage section, the unit can be suspended or supported in a variety of ways in an out-of-the-way storage location. Accordingly my utility lamp should find wide application in the home, in the plant and in the field when work has to be performed in locations where natural light in inadequate.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 1:
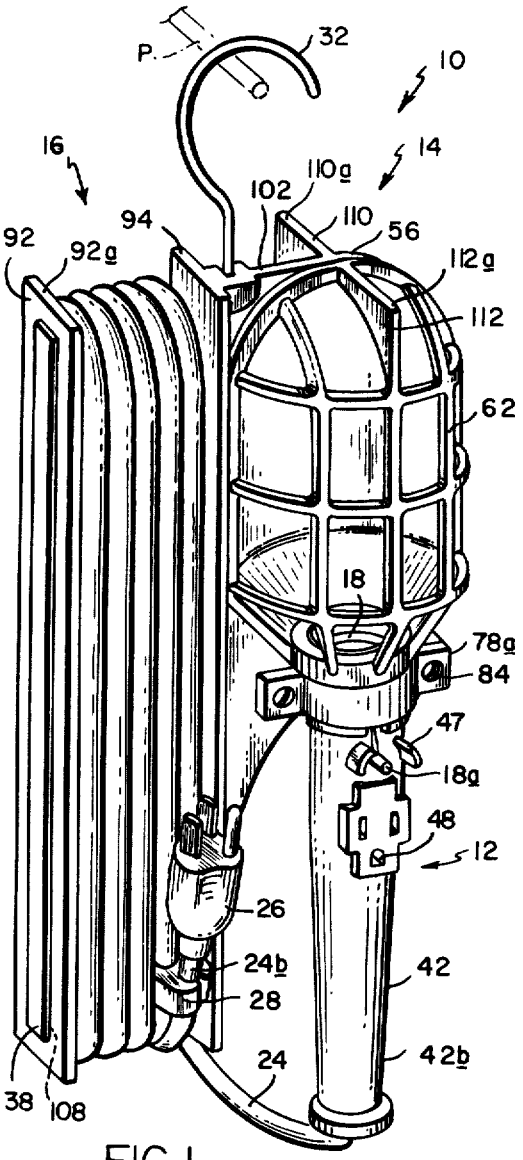
FIG. 1 is a perspective view of a utility lamp made in accordance with this invention.
Figure 2:
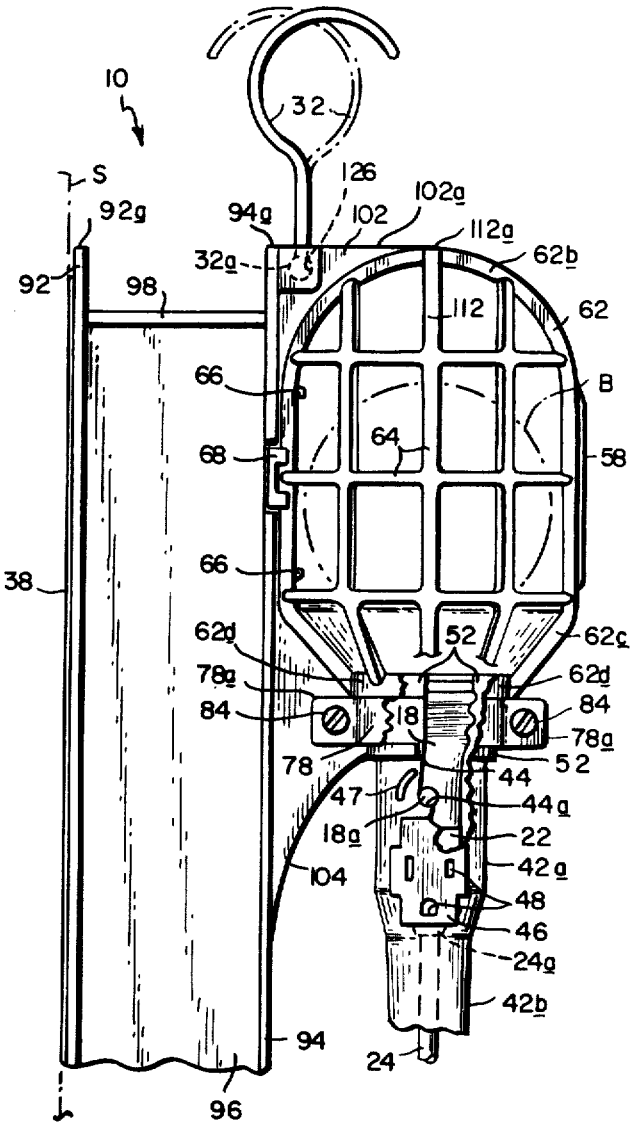
FIG. 2 is a fragmentary front elevational view with parts cut away of the FIG. 1 lamp.

Referring to FIGS. 1 and 2 of the drawings, my utility lamp indicated generally at 10 comprises a handle indicated generally at 12, a protective cage shown generally at 14 and a cord spool or storage section shown generally at 16. All of these components of the lamp are molded or formed of a suitable impact-resistant plastic such as high density polyethylene, with the cage and storage section being formed as an integral unit.

A standard switched threaded lamp receptacle or socket 18 mounted in handle 12 opens into cage 14 so that it can receive a standard electrical bulb B shown in dotted lines in FIG. 2. The receptacle switch button 18*a* is accessible through the opposite sides of handle 12. Also the receptacle includes an integral grounded electrical outlet 22 whose openings are also accessible through the side of handle 12 adjacent switch button 18*a*. A three-wire electrical cord 24 extends into the handle 12 and its end 24*a* (FIG. 2) is connected to receptacle 18, including its outlet 22. The opposite end 24*b* of the cord is terminated by a standard grounded electrical plug 26.

When the lamp is not in use, the cord 24 can be wrapped around the storage section 16. If desired, a clip 28 can be attached to the end of the cord adjacent plug 26 and arranged to clip to an adjacent turn of the cord to prevent the cord from unwrapping from section 16. In this condition, as shown in FIG. 1 the overall utility lamp constitutes a compact package which can be stored in a minimum amount of space. To facilitate convenient storage, a hook 32 is mounted to the top of the lamp. This hook is arranged so that it can assume a variety of different positions, permitting the lamp to be suspended from any one of many convenient projections such as the peg P shown in FIG. 1. Alternatively, the lamp can simply repose on its side on a suitable storage shelf or surface.

Figure 4:
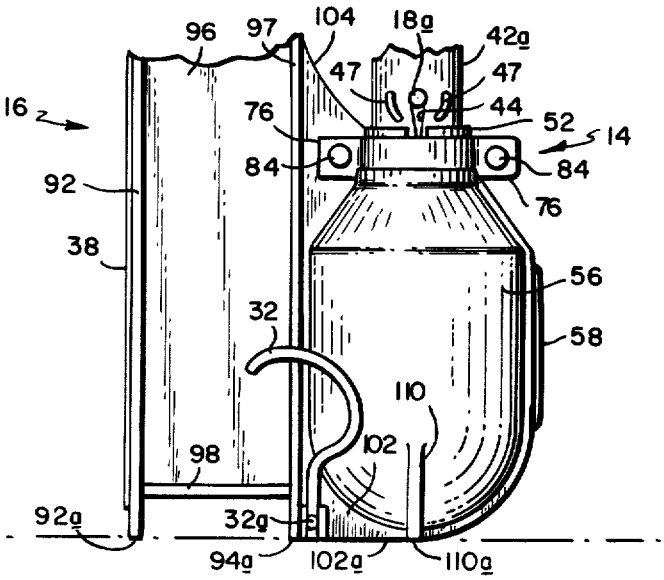
FIG. 4 is a fragmentary rear elevational view of the lamp.

When using the lamp, one simply unwraps the cord 24 from section 16 and inserts the plug 26 into the electrical outlet nearest the work site. Then the worker unwraps only enough of the cord to enable the handle to be situated in a convenient location at the work site. Then the lamp may be suspended by way of the hook 32 from any suitable elevated projection, the hook being swiveled as needed to engage over that projection. Alternatively, if there is a convenient flat surface at the work site, the lamp can repose on end as shown in FIG. 4 with the hook 32 swinging out of the way to permit that. Still further, of course, the lamp can rest on its side on any convenient surface. A special magnetic plate 38 may be incorporated into the section 16 which permits the lamp to be anchored magnetically to an upstanding ferromagnetic surface such as a steel plate, frame member or other such part.

Because the subject lamp can be secured in all of the aforementioned different ways at a work site, in all probability the lamp can be positioned so as to shed a maximum amount of light on the parts and pieces to be worked on. Furthermore, even when the work is being performed in very close quarters with energized electrical terminals, since the lamp is composed primarily of non-conductive plastic parts, there is little likelihood of the lamp causing short circuits or being a source of electrical shocks to the worker.

After the particular job is finished, the worker simply disconnects the plug 26 and rewinds the cord 24 on the storage section 16 thereby ensuring that the cord will be tangle free when he next has occasion to use the lamp.

Figure 3:
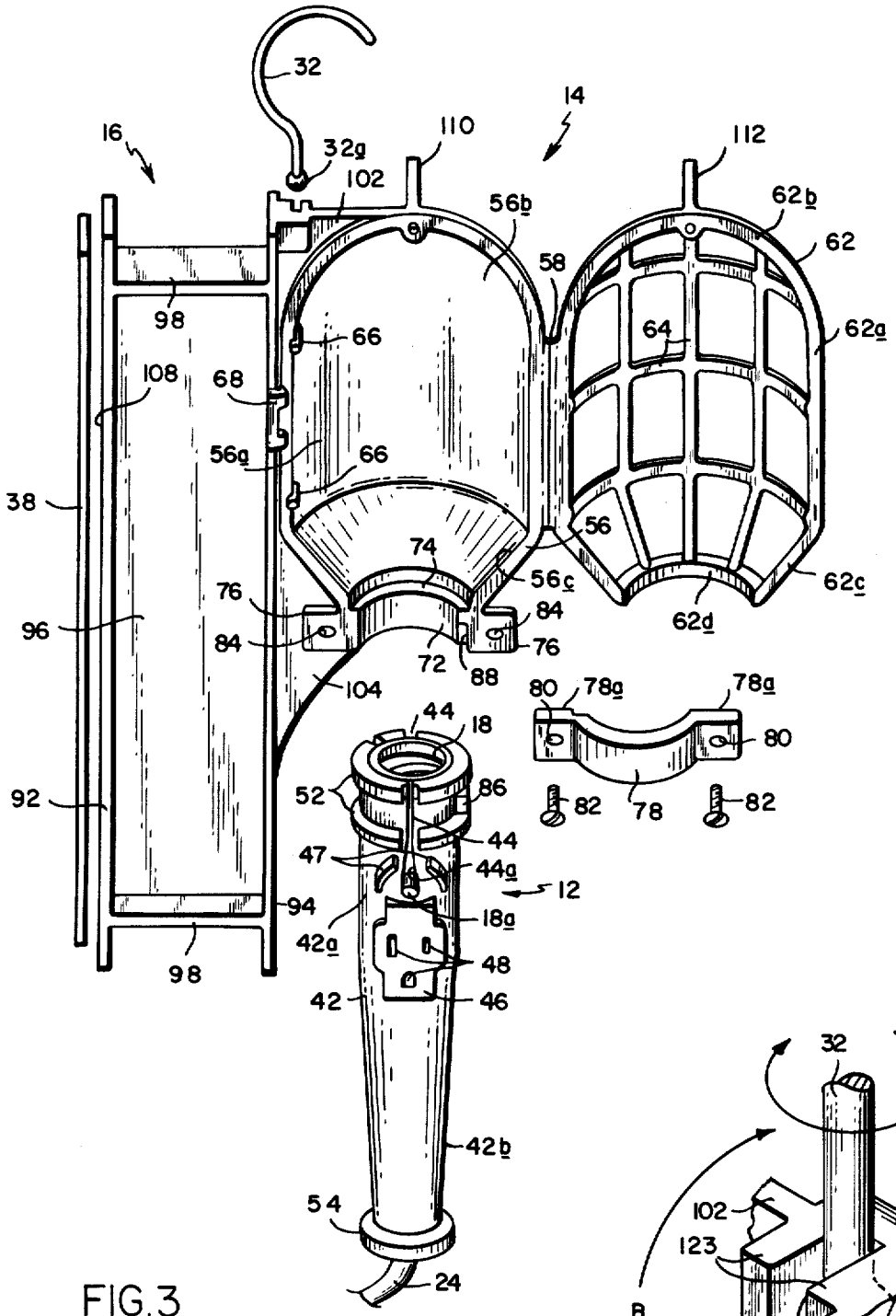
FIG. 3 is an exploded perspective view of the lamp.

Referring now to FIGS. 1 to 3 of the drawings, the lamp handle 12 comprises an extruded or molded plastic tube 42 having a relatively large diameter upper end section 42*a* and a tapered lower end section 42*b*. A pair of diametrically opposite longitudinal slits 44 are formed in the upper end segment of section 42*a* to divide the upper portion of that section into two halves which can be spread apart to permit the slidable insertion of the bulb receptacle 18 and outlet 22. The lower ends of the slits 44 are enlarged and terminate in circular cutouts 44*a* which accommodate the receptacle switch button 18*a*. Arcuate walls 47 are formed on opposite sides of each slit near the lower end thereof to shield the protruding ends of the button. Also, the handle is formed with a cross-shaped boss 46 positioned directly under one slit 44 and provided with three holes or cutouts 48 which are aligned with the three openings of the outlet 22 once the outlet is seated inside the handle.

A pair of spaced-apart circular ribs 52 are provided at the top of the tube 42 to facilitate attachment of the handle to the cage 14 as will be described later. The aforementioned slots 44 also extend through these ribs dividing each rib into two generally semi-circular sections. Another circular rib 54 is formed at the lower end of the handle 42 so that, when the user grabs the handle, it does not tend to slide out of his hand.

Still referring to FIGS. 1 to 3, the utility lamp bulb enclosure or cage 14 includes a plastic shell 56 composed of a central generally semi-cylindrical section 56*a*, an upper semi-spherical section 56*b* and a lower semi-conical section 56*c*. Hinged to the shell 56 by way of an integral "living" hinge 58 at one side of shell section 56*a* is a mating grid ir grille 62. Grid or grille 62 also has a semi-cylindrical middle section 62*a* and a semi-spherical upper section 62*b* and a semi-conical lower section 62*c* which are interconnected by a rectangular array of webs 64.

The grid 62 can be swung from an open position shown in FIG. 3 wherein it permits ready access into shell 56 to a closed section illustrated in FIGS. 1 and 2 wherein it mates with the shell forming an enclosure which extends all around the bulb B depicted in FIG. 2. When the grid 62 is in that closed position, the free edge of its section 62*a* abuts the opposing edge of the shell section 56*a*. Further, that edge is captured between a pair of posts 66 which project out from section 56*a* just inboard of that opposint edge and a resilient latch 68 molded integrally with the side edge of shell section 56*a*. The latch engages over the edge of the grid section to releasably lock that section in its closed position.

As best seen in FIGS. 2 and 3, the lower end of the shell section 56c is formed with a reduced diameter semi-cylindrical neck portion 72 which defines with the remainder of section 56c a semi-circular shelf 74 whose dimensions and diameter correspond to the dimensions and diameter of the uppermost rib 52 in handle 12. Furthermore, the length of the neck portion 72 corresponds to the spacing between the two ribs 52 on handle 12 permitting the handle to be positioned with respect to the cage so that its uppermost rib 52 seats in the groove 74.

A pair of diametrically opposite laterally-extending tabs 76 are formed at the opposite sides of the neck portion 72 just below the groove 74. After the handle 12 is seated as aforesaid with rib 52 positioned in groove 74, a semi-cylindrical plastic clamp member 78 having a pair of laterally-extending end extensions or tabs 78a is engaged over the upper end of the handle between the two ribs 52 so that its tabs 78a are in register with the tabs 76. Openings 80 are formed in tabs 78a for receiving self-threading screws 82 which are turned down into registering sockets 84 formed in tabs 76. When the screws are tightened, the handle 12 is securely but releasably connected to the cage 14 and the storage section 16 formed integrally therewith.

The cage section 62c has a lower semi-circular rib 62d which has an inner diameter which is more or less the same as the outer diameter of the upper handle rib 52 so that when the cage is in its closed position shown in FIG. 2, the rib 62d engages over that upper rib 52.

When the upper end of the handle 12 is clamped to the cage as aforesaid, the segments of that handle on opposite sides of the slits 44 are squeezed together, thereby securely retaining the receptacle 18 in the handle. Preferably also, a laterally-extending tooth 86 is formed in the handle between its flanges 52 which is arranged to seat in a mating notch 88 formed at the right hand side of the neck portion 72 in the cage 14 as best seen in FIG. 3. This tooth-notch engagement prevents relative rotation of the handle and the cage, thus ensuring that the switch button 18a and the electrical outlet openings 48 in the handle are readily accessible at the front of the utility lamp as shown in FIGS. 1 and 2.

As best seen in FIGS. 2 to 4, the cord storage section 16 is formed integrally with the cage 14 at the free side edge of shell 56. Section 16 is basically in the form of an I-beam. That is, it has a pair of spaced-apart generally rectangular side rails 92 and 94 connected by an intervening rectangular web 96. Also to further rigidify the section, a pair of upper and lower flanges 98 extend laterally between the two side rails 92 and 94 at the opposite ends of web 96. The side rail 94 is formed integrally with the cage 14 and to further strengthen and rigidify that connection, an upper web 102 extends laterally between the upper end of rail 94 and the edge of shell section 56b. Likewise, a lower web 104 extends laterally from that same rail 94 to the edges of the shell sections 56c and its neck 72. Actually the left hand tab 76 illustrated in FIG. 3 is formed integrally with that web 104.

Thus when the cord 24 is wound up on section 16, its various turns engage around the end flanges 98 and are captured between side rails 92 and 94 forming a tight compact package.

Referring now to FIGS. 1 and 3, the outer face of the left hand rail 92 is formed with a rectangular recess 108 which accommodates the magnetic strip 38. That strip may be secured in the recess by any suitable means such as adhesive so that its outer surface is flush with or projects slightly out from the outer surface of rail 92. Thus when the strip is positioned against a ferromagnetic object such as a steel plate, it will adhere to that object, thereby suspending the lamp as a whole.

Also as noted above, the utility lamp is formed so that it can repose on its head as shown in FIG. 4. To this end, a pair of generally triangular ribs 110 and 112 are formed integrally with the shell section 56b and the cage section 62b respectively. More particularly, the rib 110 projects out laterally at the very upper edge of cage section 56b and its upper edge 110a is flat and coplanar with the upper edge 102a of the web 102 as well as the upper edges 92a, 94a of the rails 92 and 94. Likewise, the rib 112 projects out laterally from the very top of the cage section 62b and its upper edge 112a is aligned and coplanar with rib edge 110a. Thus all of these coplanar surfaces define a two dimensional stand which enables the lamp to be positioned stably on a flat surface as shown in FIG. 4.

Figure 5:
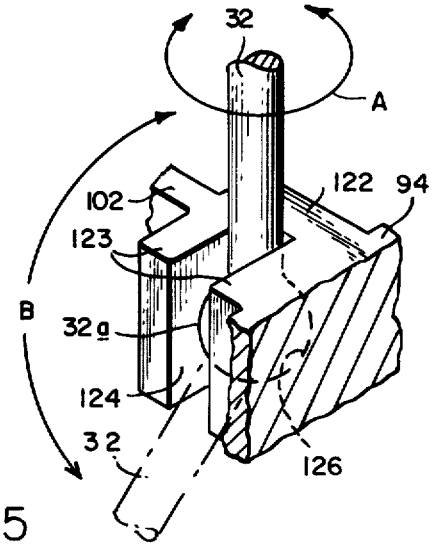
FIG. 5 is a fragmentary perspective view on a larger scale showing a portion of the FIG. 1 lamp in greater detail.

Referring now particularly to FIGS. 2 and 5, the hook 32 is connected to the web 102 extending between cage 14 and section 16. More particularly, a pair of spaced-apart parallel walls 123 are formed integrally with rail 94 and web 102. The walls project out on the shell side of that web, defining between them a vertical slot 124 whose width is slightly greater than the diameter of the wire hook 32. The opposing faces of the walls 123 are formed with spherical recesses or dimples 126 which are arranged to rotatively receive a bulbous or spherical hook end 32a. The walls 123 are sufficiently resilient that, when the bulb 32a is forced between the walls, the walls spread apart. Then, when the bulb is seated in the recesses 126, the walls snap together, thereby rotatively capturing the hook end between them.

With this arrangement, the hook 32 can rotate 360° about a vertical axis as indicated by the arrow A in FIG. 5. Furthermore, it can be swung up and down vertically through the slot 124 almost 180° as indicated by the arrow B in that same figure. Thus the hook can swivel as needed to enable it to hook over almost any convenient projection at the work site. Also, when the utility lamp is stood on end as shown in FIG. 4, the hook can be swung up out of the way as shown in that figure. Preferably, the walls 123 are sufficiently resilient that they grip the hook end 32a sufficiently strongly that the hook does not flop about. Therefore, when it is swung up out of the way as shown in FIG. 4, it remains in that position until forcibly displaced therefrom.

In use, the lamp 10 can be hung from an elevated support by way of its hook 32, with the hook pivoting in one direction or the other as indicated in FIG. 2 to enable the lamp to be hung so as to illuminate the object being worked on. If such a projection is not available but there is a ferromagnetic object in the vicinity, the lamp 10 can be suspended from that object by way of its magnetic strip 38. If neither of the aforesaid courses is available, but there is a flat surface at hand, the lamp can simply be rested on its side as shown in FIG. 1 (turned sideways) or the lamp can be stood on end as depicted in FIG. 4.

To use the lamp, the worker simply inserts the plug 26 into a nearby electrical outlet and unwinds only that amount of the cord 24 that enables the lamp handle 12 to be positioned at the work site. Accordingly, the lamp cord 24 remains substantially straight and untangled. The lamp, while illuminating the work site, also includes the electrical outlet 22 which permits an auxiliary device such as an electrical tool to be powered from the lamp. When the work is done, the cord 24 is rewound onto section 16 and the lamp stored away. The present lamp is formed substantially entirely of relatively inexpensive plastic material. Therefore its overall cost is kept to a minimum. Furthermore all of the various parts of the lamp are connected together and it is not even necessary to remove any fastenings in order to replace the bulb B. One simply displaces the latch 68 and swings the cage 62 to its open position shown in FIG. 3 to gain access to the bulb. For all of the aforesaid reasons, then, this electrical appliance should prove to be a very marketable item.

It will thus be seen that the objects set forth above, among those made apparent from the preceding description, are efficiently attained. Also, certain changes may be made in the above description or shown in the accompanying drawings. For example, in some instances, it may be desirable to market the cage and integral holder section of the present lamp as a separate unit for attachment to a conventional utility lamp handle and cord. This is possible because the clamp member 78 will fit around the handles of many present-day utility lamps. Therefore, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. A utility lamp comprising
A. a tubular handle;
B. a bulb receptacle mounted in said handle;
C. an electrical cord having one end extending into said handle and being connected to said receptacle and having its other end terminated by an electrical connector;
D. a bulb cage for protectively enclosing a bulb positioned in the receptacle, said bulb cage comprising
1. a first section;
2. a second section;
3. a hinge connecting said first and second sections so that they are movable relatively between a closed position wherein they protectively enclose a bulb in the receptacle and an open position wherein they are spaced apart so that access may be had to a bulb in the receptacle; and
4. means for releasably locking the sections in the closed position;
E. means for removably securing the bulb cage to the handle; and
F. means integral with the cage defining a spool extending generally parallel to said handle about which can be wound the length of cord extending from the handle, said handle, cage and spool defining means all formed of an impact resistant plastic material.

2. The utility lamp defined in claim 1 wherein
A. said first and second sections and said hinge are formed as a unitary part; and
B. said hinge is a "living" hinge.

3. The utility lamp defined in claim 1 wherein
A. said first section is in the form of a shell;
B. said second section is in the form of a grille; and
C. said securing means connects the shell to the handle.

4. The utility lamp defined in claim 1 and further including means for preventing relative rotation of the bulb cage and the handle.

5. The utility lamp defined in claim 1 and further including stand defining means formed on the cage and the spool defining means defining a plane at the top of the lamp which enables the lamp to stand on end on a horizontal surface.

6. The utility lamp defined in claim 5 wherein said stand defining means comprises
A. at least one tab projecting laterally from the top of the cage; and
B. the upper end of the spool defining means.

7. The utility lamp defined in claim 1 wherein said spool defining means comprises
A. a pair of spaced-apart rails extending parallel to said handle; and
B. a generally rectangular web connecting said rails so as to form an I-beam.

8. The utility lamp defined in claim 7 and further including magnet means mounted to the surface of the rail remote from said handle so as to permit said utility lamp to be suspended by said magnet means from a ferromagnetic object.

9. The utility lamp defined in claim 1 and further including
A. a hook; and
B. means for securing the hook to the top of the lamp.

10. The lamp defined in claim 9 wherein the securing means comprises
A. a ball formed at one end of the hook; and
B. a socket formed at the upper end of the cage for rotatably receiving the ball so as to form a universal joint which permits the hook to swivel relative to the cage.

11. The lamp defined in claim 1 and further including
A. an electrical outlet connected electrically to the receptacle; and
B. means defining openings in the wall of the handle so as to facilitate the electrical connection of a plug to said outlet.

12. A utility lamp comprising
A. a generally tubular handle, one end of the handle being slotted lengthwise;
B. a bulb receptacle received in the slotted end of the handle;
C. an electrical cord having one end extending into the housing and connected electrically to the receptacle and having its other end terminated by an electrical connector;
D. means defining a protective enclosure for a bulb positioned in the receptacle; and
E. means for clamping the enclosure defining means to the slotted end of the handle thereby automatically anchoring the receptacle in the handle.

13. The lamp defined in claim 12 and further including a cord storage section attached to the enclosure defining means, said storage section being in the form an elongated I-beam extending generally parallel to the handle and about which the cord extending from the handle can be wound.

14. The lamp defined in claim 13 wherein the enclosure defining means and storage section are formed as a unitary part.

15. The lamp defined in claim 13 wherein the handle, enclosure defining means and cord storage section are all made of an impact resistant plastic.

16. The lamp defined in claim 13, and further including a permanent magnet anchored to the cord storage section, so as to enable the lamp to be suspended from a ferromagnetic object.

17. The lamp defined in claim 12 and further including

A. a hook; and

B. means for anchoring the hook to the enclosure defining means so as to permit the lamp to be suspended from an object engaged by the hook.

18. The lamp defined in claim 17 wherein the anchoring means comprises a universal joint between the hook and the enclosure defining means.

19. The lamp defined in claim 12 wherein the enclosure defining means comprises

A. a generally semi-cylindrical shell;

B. a generally semi-cylindrical grille structure;

C. a hinge connecting an edge of the shell to an edge of the grille structure permitting the grille structure to move from a closed position wherein it lies opposite the shell to an open position permitting access into the shell; and D. means for removably locking the grille structure in its closed position.

20. The lamp defined in claim 19 wherein the shell, grille structure and hinge are formed as an integral plastic part.

21. The lamp defined in claim 19 wherein the clamping means clamps the shell to the handle.

22. The lamp defined in claim 12 and further including means defining a stand at the free upper end of the enclosure defining means permitting the utility lamp to be stood on end on a horizontal surface.

23. A bulb cage and cord holder unit for a utility lamp of the type having a handle containing a lamp receptacle and a cord extending from the handle wherein the bulb cage comprises A. a first section;

B. a second section integral with first section;

C. an integral living hinge connecting said first and second sections so that they are movable relatively between a closed position wherein they protectively enclose a bulb in the receptacle and an open position wherein they are spaced apart so that access may be had to a bulb in the receptacle;

D. means for releasably locking the sections in the closed position; and

E. said holder comprises means defining a cord spool formed integrally with the cage.

24. The unit defined in claim 23 wherein

A. said first section is in the form of a shell;

B. said second section is in the form of a grille; and

C. said securing means connects the shell to the handle.

25. The unit defined in claim 24 and further including stand defining means formed on the cage and the spool defining means defining a plane at the top of the cage which enables the cage to stand on end on a horizontal surface.

26. The unit defined in claim 25 wherein said stand defining means comprises

A. at least one tab projecting laterally from the top of the cage; and

B. the upper end of the spool defining means.

27. The unit defined in claim 26 wherein said spool defining means comprises

A. a pair of spaced-apart rails; and

B. a generally rectangular web connecting said rails so as to form an I-beam.

28. The unit defined in claim 27 and further including

A. a hook; and

B. means for securing the hook to the top of the cage.

29. The unit defined in claim 28 wherein the securing means comprises

A. a ball formed at one end of the hook; and

B. a socket formed at the upper end of the cage for rotatably receiving the ball so as to form a universal joint which permits the hook to swivel relative to the cage.

30. The unit defined in claim 27 and further including magnet means mounted to the surface of a rail so as to permit said utility lamp to be suspended by said magnet means from a ferromagnetic object.

* * * * *